US008264420B2

(12) United States Patent
Sato et al.

(10) Patent No.: US 8,264,420 B2
(45) Date of Patent: Sep. 11, 2012

(54) ANTENNA DEVICE AND ANTENNA WATERPROOF STRUCTURE

(75) Inventors: Kyuichi Sato, Tokyo (JP); Hisashi Takisawa, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 481 days.

(21) Appl. No.: 12/554,017

(22) Filed: Sep. 4, 2009

(65) Prior Publication Data

US 2010/0090923 A1 Apr. 15, 2010

(30) Foreign Application Priority Data

Oct. 9, 2008 (JP) ..... P2008-262315

(51) Int. Cl.
*H01Q 1/42* (2006.01)
*H01Q 1/32* (2006.01)

(52) U.S. Cl. ..... 343/872; 343/711; 343/713

(58) Field of Classification Search ..... 343/872, 343/711, 713

See application file for complete search history.

(56) References Cited

U.S. PATENT DOCUMENTS 7,436,366 B2 * 10/2008 Takisawa et al. ..... 343/711
7,528,793 B2 * 5/2009 Yoneya et al. ..... 343/873
7,567,214 B2 * 7/2009 Takisawa et al. ..... 343/872
7,646,345 B2 * 1/2010 Takisawa et al. ..... 343/700 MS
8,026,864 B2 * 9/2011 Noro et al. ..... 343/872

FOREIGN PATENT DOCUMENTS

| | | |
|---|---|---|
| JP | 6140824 | 5/1994 |
| JP | 3011245 | 3/1995 |
| JP | 8-148932 | 6/1996 |
| JP | 2006-237917 | 9/2006 |
| JP | 2006-245719 | 9/2006 |

OTHER PUBLICATIONS

Japanese Office Action issued on Mar. 2, 2011 with English translation.
Japanese Office Action with English translation.

* cited by examiner

*Primary Examiner* — Hoang V Nguyen
(74) *Attorney, Agent, or Firm* — Whitham Curtis Christofferson & Cook, PC

(57) ABSTRACT

An antenna device includes an antenna module configured to receive radio waves. A plate has a plurality of first through holes. A cover is coupled with the plate to define a space accommodating the antenna module. The cover includes a rib and a side wall surrounding the antenna module. The side wall has an end face opposing the plate and formed with a plurality of threaded holes. The rib is projected from the end face. A gasket has a part formed with a plurality of openings and is disposed between the rib and the plate. A plurality of screws are respectively screwed into the threaded holes through the first through holes and the openings. At least a part of each of the screws is surrounded by an associated one of the openings.

10 Claims, 11 Drawing Sheets

ANTENNA DEVICE AND ANTENNA WATERPROOF STRUCTURE

BACKGROUND

The present invention relates to an antenna device for receiving a satellite signal transmitted from an artificial satellite and, more particularly, a structure gasket for waterproofing the antenna device.

Various antenna devices for receiving the satellite signal transmitted from the artificial satellite are proposed. As such antenna device, the GPS antenna device for receiving the GPS signal transmitted from the earth orbiting satellite, the SDARS antenna device for receiving the SDARS signal transmitted from the SDARS satellite, etc. can be exemplified.

The system for receiving the signal waves transmitted from a plurality of artificial satellites orbiting the earth, respectively by the receiver and then detecting a present position of the receiver itself based on information contained in the received signal waves, i.e., the Global Positioning System, is spreading recently. Commonly this system is called the GPS (Global Positioning System) in many countries such as Japan, the USA, etc. Also, commonly such system utilizes the GPS satellites that the Department of Defense of the USA manages. As the similar system, there are "GALILEO" utilized in Europe, "GLONASS" utilized in Russia, and the like. For convenience, the positioning system using the artificial satellite, the artificial satellite used in this positioning system, the signal wave transmitted from this artificial satellite, the receiver for receiving this signal wave, etc. are referred herein to as the GPS, the GPS satellite, the GPS signal, the GPS receiver, etc. respectively.

The GPS can detect the present position of the GPS receiver itself in substantially real time with high precision. For this reason, the GPS is used mainly in such an application that the GPS receiver is installed into a mobile body such as an automobile, an aircraft, a mobile phone, or the like, for example, to measure the present position of this mobile body.

At present, the GPS receiver suitable for the automobile, the so-called onboard GPS receiver, is rapidly spreading. In installing the GPS receiver into an automobile, a GPS receiving antenna device for receiving the GPS signal is set up to an outside of the automobile such as a roof, or the like, for example.

The SDARS (Satellite Digital Audio Radio Service) is the service provided by the digital broadcast utilizing the satellite (referred to as the "SDARS satellite" hereinafter) in the United States. That is, the digital radio receiver that can receive a satellite wave transmitted from the SDARS satellite or a terrestrial wave to listen to the digital radio broadcast is developed in the United States, and put to practical use. At present, in the United States, two broadcast stations, XM and Sirius, provide the radio programs on 250 channels or more in total throughout the country. Usually this digital radio receiver is installed into the mobile body such as the automobile, or the like, and can catch the radio broadcast by receiving a radio wave whose frequency is in about 2.3 GHz band. That is, the digital radio receiver is the radio receiver that can catch the mobile broadcast. Since a frequency of a receiving radio wave is about 2.3 GHz band, a receiving wavelength (resonance wavelength) $\lambda$ at that time is about 128.3 mm. Here, the terrestrial wave is produced by receiving the satellite wave by the earth station once, then shifting slightly a frequency of the satellite wave, and then retransmitting the wave as a linearly polarized radio wave. In other words, the satellite wave is a circularly polarized radio wave whereas the terrestrial wave is the linearly polarized radio wave.

The XM satellite radio antenna device receives the circularly polarized radio wave from two stationary satellites, and receives the linearly polarized radio wave via the ground linearly polarizing equipment in the dead space. In contrast, the Sirius satellite radio antenna device receives the circularly polarized radio wave from three earth orbiting satellites (synchronous type), and receives the linearly polarized radio wave via the ground linearly polarizing equipment in the dead space.

In this manner, since the radio wave whose frequency is about 2.3 GHz band is used in the digital radio broadcast, in many cases the antenna device for receiving this radio wave is set up outside the room. Therefore, upon installing the digital radio receiver into the mobile body such as the automobile, or the like, the antenna device is attached to the outside of the automobile such as a roof, or the like of the mobile body.

Various antenna devices for receiving the satellite signal transmitted from the artificial satellite are proposed. For example, Patent Document 1 discloses the antenna device in which the gasket can be positioned easily with respect to the top cover.

Also, Patent Document 2 discloses the antenna device which causes an assembly thereof to be easy.

Such an antenna device 10 that is disclosed in Patent Document 1 and Patent Document 2 will be explained below with reference to FIG. 1. The illustrated antenna device 10 is the GPS signal receiving antenna device.

The antenna device 10 includes an antenna case 13, an antenna module 14, a gasket 15, and a signal line 16 which is a coaxial cable. The antenna case 13 is constructed by joining a dome-shaped top cover 11 and a bottom plate 12. The antenna module 14 is accommodated in the top cover 11. The gasket 15 is provided to a joined portion between the top cover 11 and the bottom plate 12 to ensure a sealing property of the antenna case 13. In this case, the gasket 15 is also called the waterproof packing because this member established a waterproofing. The signal line 16 is connected to the antenna module 14.

The antenna module 14 has an antenna element 20 and a circuit board 21. An antenna for receiving the GPS signal transmitted from the GPS satellite is formed on the antenna element 20. A circuit for applying various signal processes such as amplification of the GPS signal received by the antenna element 20 (referred to as a "signal processing circuit" hereinafter) is formed on the circuit board 21. The antenna element 20 and the circuit board 21 are joined mutually with a double-sided tape 22.

The signal line 16 for supplying the GPS signal to the outside of the antenna case 13 is connected to the circuit board 21. Also, a shield case 24 for shielding the signal processing circuit is attached to a main face of the circuit board 21, which is opposite side to the side on which the antenna element 20 is arranged. The signal line 16 is led out through a notched portion formed in the top cover 11 (described later).

The antenna device 10 is integrated when the top cover 11 and the bottom plate 12 are secured mutually by three screws 26 in a state that the antenna module 14 and the gasket 15 are accommodated in an internal space of the top cover 11.

The gasket 15 is made of a resin material such as silicon rubber. The gasket 15 has a base portion 15*a* for covering the whole face of the antenna module 14, and a gasket portion 15*b* for covering an outer periphery of the signal line 16 in a position that corresponds to a notched portion 11*a* (FIGS. 3A to 3C) formed in the top cover 11.

A configuration of the gasket 15 will be explained below in more detail with reference to FIGS. 2A to 2G.

The base portion 15*a* has a recess portion 15*c*. The position of antenna module 14 is regulated by this recess portion 15*c*. A shape of the recess portion 15*c* is formed to cover substantially the overall bottom face of the antenna module 14.

The gasket 15 is set between the top cover 11 and the bottom plate 12 when the top cover 11 and the bottom plate 12 are joined, and is provided for the purpose of ensuring the airtightness at the joining portion. The gasket portion 15*b* is formed upright on the base portion 15*a* in a position that corresponds to the notched portion 11*a* formed in the top cover 11. The gasket portion 15*b* has a hole portion 15*d*, through which the signal line 16 is passed, in its center portion.

The gasket 15 has a projection 15*e* that extends outward from the lower side of the hole portion 15*d*. This projection 15*e* constitutes a waterproof structure when this portion is brought into contact with the lower side of the signal line 16. The projection 15*e* is provided to expose from the notched portion 11*a* of the top cover 11, and constitutes a part of the face of the antenna main body. Also, the gasket 15 has four projections 15*f* provided to the lower face of the base portion 15*a*. These projections 15*f* pass through the bottom plate 12 and a resin sheet 31, and are exposed from the bottom face of the antenna main body. These projections 15*f* serve as a slip stopper when the antenna main body is set on the roof of the automobile.

Returning to FIG. 1, a single concave portion 12*a* is formed on a center portion of the bottom plate 12. A permanent magnet 30 is attached into the concave portion 12*a*. This permanent magnet 30 is provided to attract and fix the antenna device 10 onto the roof of the automobile. Also, the resin sheet 31 for the purpose of preventing a scratch on the roof of the automobile is attached onto the main face on the side, which faces to the outside of the bottom plate 12, over the almost whole part of this main face. The model number, the name, etc. of the antenna device 10 are printed on this resin sheet 31.

A configuration of the top cover 11 will be explained below with reference to FIGS. 3A to 3C.

The top cover 11 has a container portion 11*c* that is encircled with a substantially rectangular waterproof rib 11*b*. The container portion 11*c* accommodates the box-shaped antenna module 14. Also, protrusions 11*d* are provided integrally with a top face of an inner wall of the top cover 11 at four locations in the container portion 11*c*. These protrusions 11*d* are provided in the positions that contact the areas near four corners of the antenna element 20.

Also, the top cover 11 has a gasket receiving portion 11*e* for receiving the gasket portion 15*b* of the gasket 15, and three threaded holes 11*f* into which the screw 26 is screwed respectively.

As shown in FIG. 3C, an outer peripheral edge of an end portion 11*b*-1 of the waterproof rib 11*b* is chamfered. The end portion 11*b*-1 of the waterproof rib 11*b* is brought into contact with the gasket 15 when three screws 26 are screwed.

Also, twelve reinforcing ribs 11*g* are formed around the waterproof rib 11*b* of the top cover 11. The reinforcing ribs 11*g* are arranged to correspond to a shape of the gasket 15. In other words, a virtual shape formed when ends of the reinforcing ribs 11*g* are connected assumes such a shape that corresponds substantially to the shape of the gasket 15.

Therefore, as shown in FIGS. 4A and 4B, a position of the gasket 15 can be defined easily with respect to the top cover 11. As a result, workability in assembling the antenna device can be improved. In this case, the gasket 15 and the bottom plate 12 are secured to the top cover 11 by three screws 26, as described above. Therefore, unlike the state shown in FIGS. 4A and 4B, actually an upper outer peripheral edge of the gasket 15 is brought into contact with right-angled corner portions of the reinforcing ribs 11*g* by screwing pressure given by three screws 26.

Also, as shown in FIG. 3A, a grid-shaped rib 11*h* is formed on the inner wall top face of the inner wall of the top cover 11. Accordingly, a rigidity of the top cover 11 can be improved. The grid-shaped rib 11*h* is formed on a top face of an inner wall of the container portion 11*c*, which is encircled with the waterproof rib 11*b*, over the whole area except a square area including an almost center portion. This almost center portion in which the grid-shaped rib 11*h* is not formed is constructed such that power feeding pins protruded toward a receiving face side of the antenna element 20 are positioned therein. That is, the almost center portion serves a clearance for the power feeding pins when the antenna element 20 is contained in the container portion 11*c*.

A configuration of the bottom plate 12 will be explained below with reference to FIGS. 5A to 5D.

A single concave portion 12*a* is formed in the center portion of the bottom plate 12. The permanent magnet 30 is provided in the concave portion 12*a*. The permanent magnet 30 is provided to attract and fix the antenna device 10 to the roof of the automobile. The bottom plate 12 has four through holes 12*b* through which four projections 15*f* of the gasket 15 are passed. Also, the bottom plate 12 has three holes 12*c* through which the screw 26 is passed respectively.

As shown in FIG. 1, a resin sheet 31 for protecting the roof of the automobile from scratch is attached onto the main face on the side, which faces to the outside of the bottom plate 12, over the almost whole face of this main face. The model number, the name, etc. of the antenna device 10 are printed on this resin sheet 31.

A combined state of the bottom plate 12 and the gasket 15 is shown in FIG. 6. As shown in FIG. 6, a diameter of the through holes 12*b* formed in the bottom plate 12 is larger than a diameter of the projections 15*f* of the gasket 15.

A length of the projections 15*f* is set short to such an extent that, even when the projections 15*f* are elastically deformed in the lateral direction, the projections 15*f* do not contact the corner of the through holes 12*b*. Also, as shown in FIGS. 2A to 2G, top end portions of the projections 15*f* are rounded.

According to such configuration, even when the projections 15*f* are elastically deformed in the lateral direction, the projections 15*f* of the gasket 15 never come into contact with the corner of the through holes 12*b* in the bottom plate 12. Therefore, the projections 15*f* can escape into the through holes 12*b* in the bottom plate 12, and thus the workability in assembling the antenna can be improved.

[Patent Document 1] Japanese Patent Publication No. 2006-237917A

[Patent Document 2] Japanese Patent Publication No. 2006-245719A

In the conventional antenna device 10, as shown in FIG. 3A, the waterproof rib 11*b* is provided on the inner side apart from the case side face of the top cover 11. In other words, a plurality of reinforcing ribs 11*g* are provided between the waterproof rib 11*b* and the case side face of the top cover 11. A dead space is formed in the top cover 11 because a plurality of reinforcing ribs 11*g* are provided. Therefore, the conventional antenna device 10 is increased in product size.

Also, as shown in FIG. 4A and FIG. 6, in the conventional antenna device 10, a plurality of screws 26 used to secure the gasket 15 and the bottom plate 12 to the top cover 11 are screwed into the threaded holes 11*f* of the top cover 11 in the positions that do not pass through the gasket 15 and are in close vicinity of the gasket 15. Therefore, in the conventional antenna device 10, the waterproof property in the inside of the antenna module 14 is ensured only by virtue of the close contact between the waterproof rib 11*b* provided to the top cover 11 and the gasket 15. As a result, the waterproof is not sometime enough.

As shown in FIG. 11A, in the conventional antenna device 10, when three screws 26 are screwed into three threaded bosses 11*f* of the top cover 11 through the holes 12*c* in the bottom plate 12, the gasket 15 is set between the top cover 11 and the bottom plate 12 and is fixed by the screws. Therefore, in the conventional antenna device 10, the waterproof property in the inside of the antenna module 14 is ensured only by virtue: of the close contact between the waterproof rib 11*b* provided to the top cover 11 and the gasket 15. As a result, such a problem exists that the waterproof is not enough.

SUMMARY

It is therefore one advantageous aspect of the present invention to provide a small-sized antenna device.

It is therefore another advantageous aspect of the present invention to provide an antenna device capable of enhancing the waterproof property.

According to one aspect of the invention, there is provided an antenna device, comprising:

an antenna module configured to receive radio waves;

a plate having a plurality of first through holes;

a cover coupled with the plate to define a space accommodating the antenna module, the cover comprising:

a side wall surrounding the antenna module, the side wall having an end face opposing the plate and formed with a plurality of threaded holes; and a rib projected from the end face;

a gasket having a part formed with a plurality of openings and disposed between the rib and the plate; and a plurality of screws respectively screwed into the threaded holes through the first through holes and the openings, wherein at least a part of each of the screws is surrounded by an associated one of the openings.

The antenna device may be configured such that: the side wall has a first part having a first thickness and a second part having a second thickness thicker than the first thickness; and the end face is provided in the second part.

The antenna device may be configured such that: the antenna module is configured to receive a GPS signal as the radio waves.

The antenna device may be configured such that: the antenna device is configured to receive a Satellite Digital Audio Radio Service signal as the radio waves.

The antenna device may be configured such that: the openings are second through holes.

The antenna device may be configured such that: each of the screws has a screw head having a diameter larger than a diameter of each of the second through holes.

According to one aspect of the invention, there is provided a waterproof structure for an antenna device including an antenna module configured to receive radio waves, the waterproofing structure comprising:

a cover adapted to be coupled with a plate having a plurality of first through holes to define a space accommodating the antenna module, the cover comprising:

a side wall adapted to surround the antenna module, the side wall having an end face adapted to oppose the plate and formed with a plurality of threaded holes; and a rib projected from the end face; and a gasket having a part formed with a plurality of openings and adapted to be disposed between the rib and the plate, wherein each of the openings is adapted to surround at least a part of a screw which is configured to be screwed into one of the threaded holes through one of the first through holes and one of the openings.

The waterproof structure may be configured such that: the side wall has a first part having a first thickness and a second part having a second thickness thicker than the first thickness; and the end face is provided in the second part.

The waterproof structure may be configured such that: the openings are second through holes.

The waterproof structure may be configured such that: a diameter of each of the second through holes is smaller than a screw head of the screw.

DETAILED DESCRIPTION OF EXEMPLIFIED EMBODIMENTS

Figure 1:
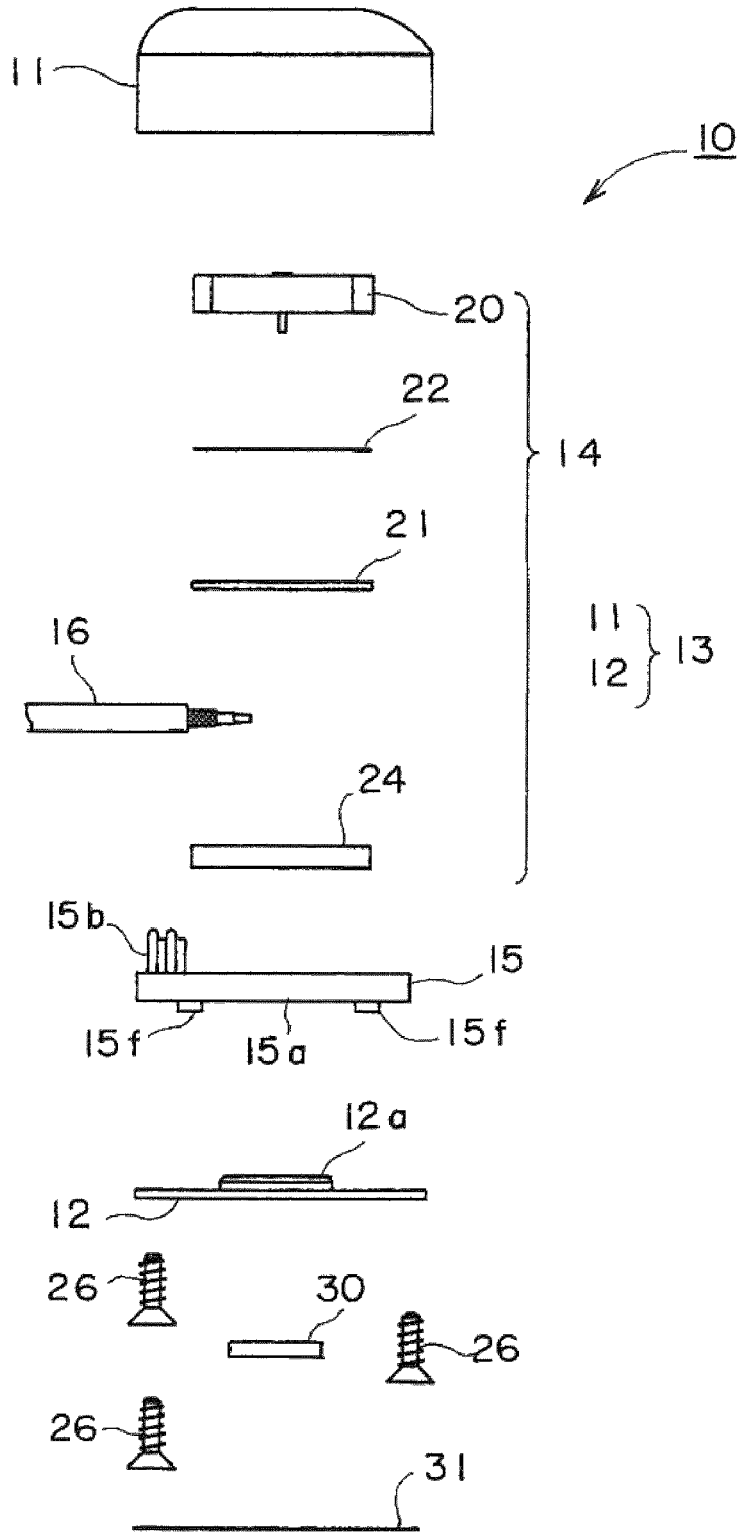
FIG. 1 is a view showing a conventional antenna device in a disassembled state.
Figure 2E:
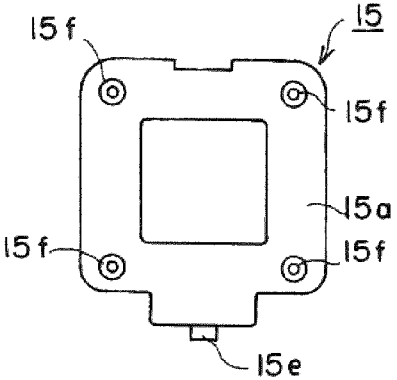
FIG. 2E is a bottom view of the gasket.
Figure 2C:
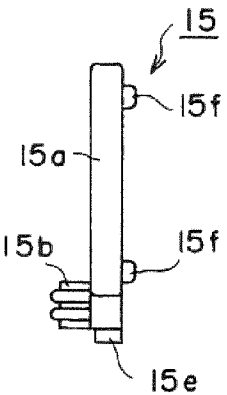
FIG. 2C is a right side view of the gasket.
Figure 2D:
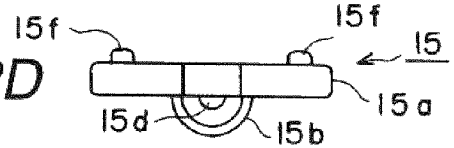
FIG. 2D is a rear view of the gasket.
Figure 2A:
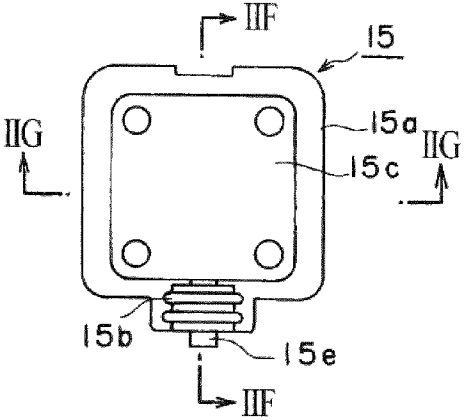
FIG. 2A is a plan view of a gasket of the conventional antenna device.
Figure 2B:
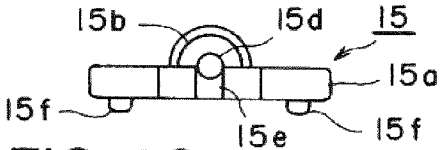
FIG. 2B is a front view of the gasket
Figure 2G:
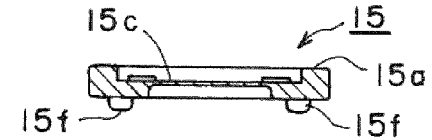
FIG. 2G is a sectional view taken along a line IIG-IIG in FIG. 2A.
Figure 2F:
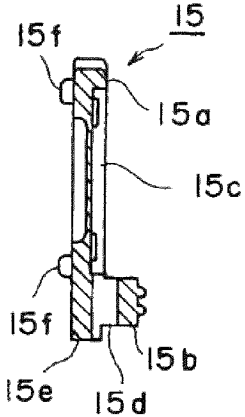
FIG. 2F is a sectional view taken along a line IIF-IIF in FIG. 2A.
Figure 3C:
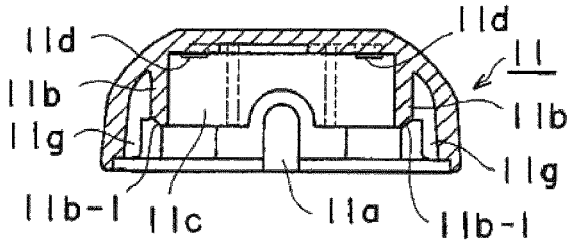
FIG. 3C is a sectional view taken along a line IIIC-IIIC in FIG. 3A.
Figure 3B:
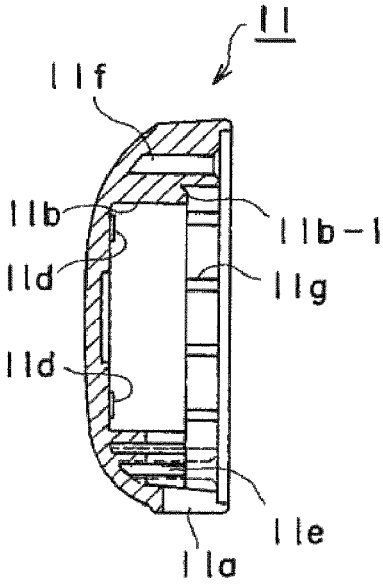
FIG. 3B is a sectional view taken along a line IIIB-IIIB in FIG. 3A.
Figure 3A:
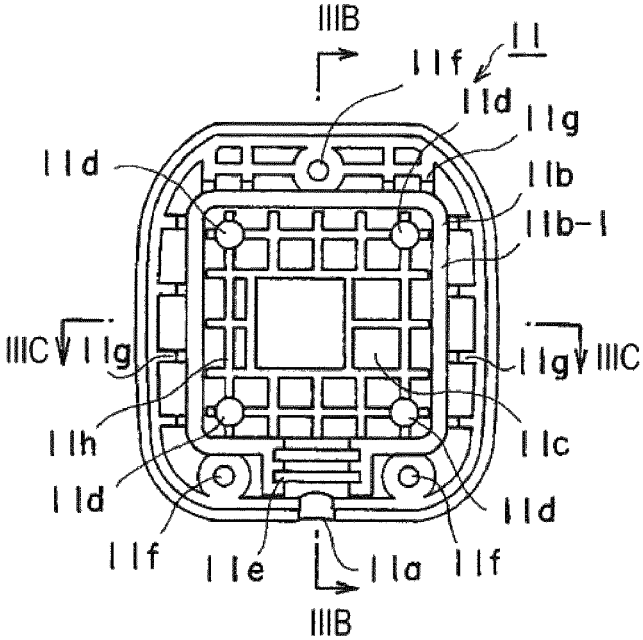
FIG. 3A is a bottom view of a top cover of the conventional antenna device.
Figure 4B:
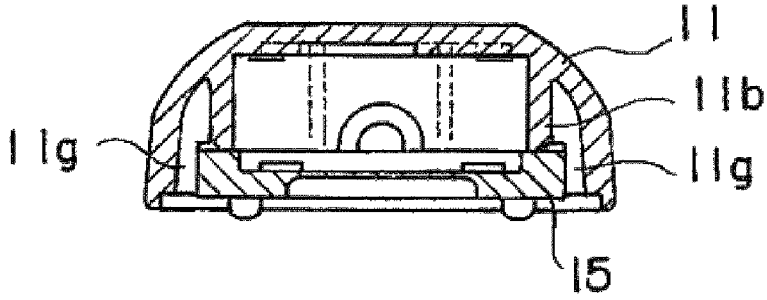
FIG. 4B is a sectional view taken along a line IVB-IVB in FIG. 4A.
Figure 4A:
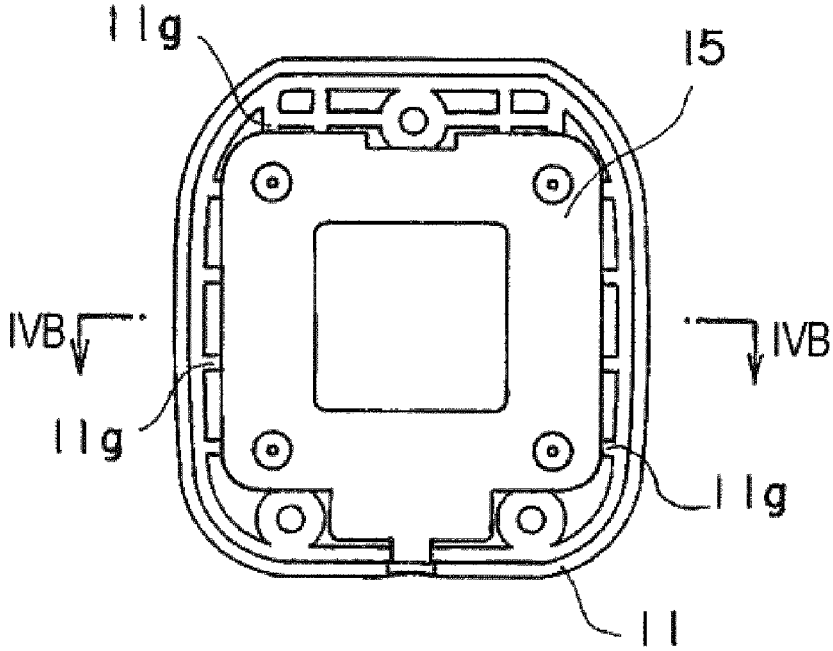
FIG. 4A is a bottom view of the top cover shown in FIG. 3A assembled with the gasket shown in FIG. 2A.
Figure 5A:
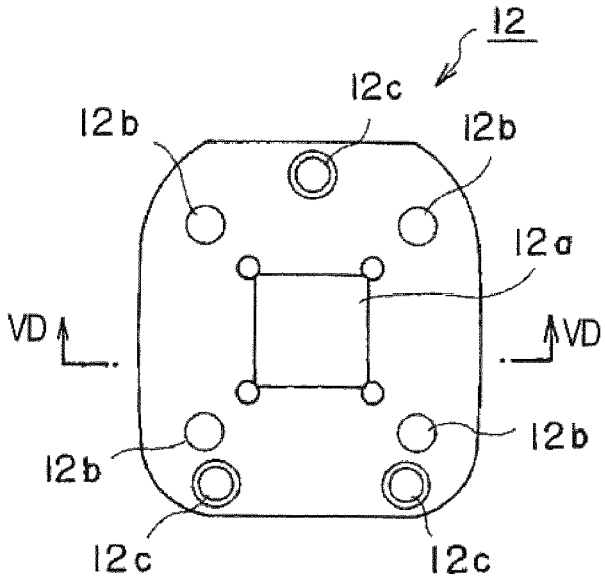
FIG. 5A is a bottom view of a bottom plate of the conventional antenna device.
Figure 5C:
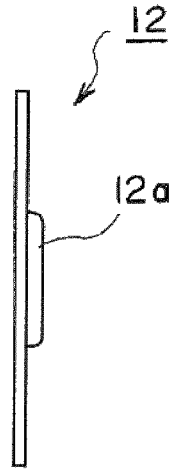
FIG. 5C is a side view of the bottom plate.
Figure 5B:
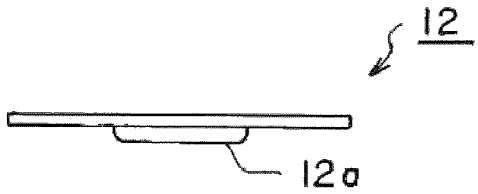
FIG. 5B is a front view of the bottom plate.
Figure 5D:
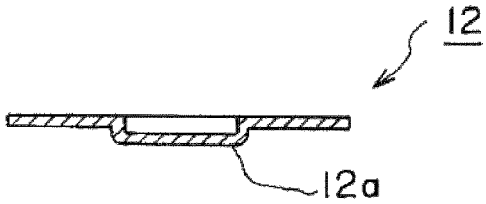
FIG. 5D is a sectional view taken along a line VD-VD in FIG. 5A.
Figure 6:
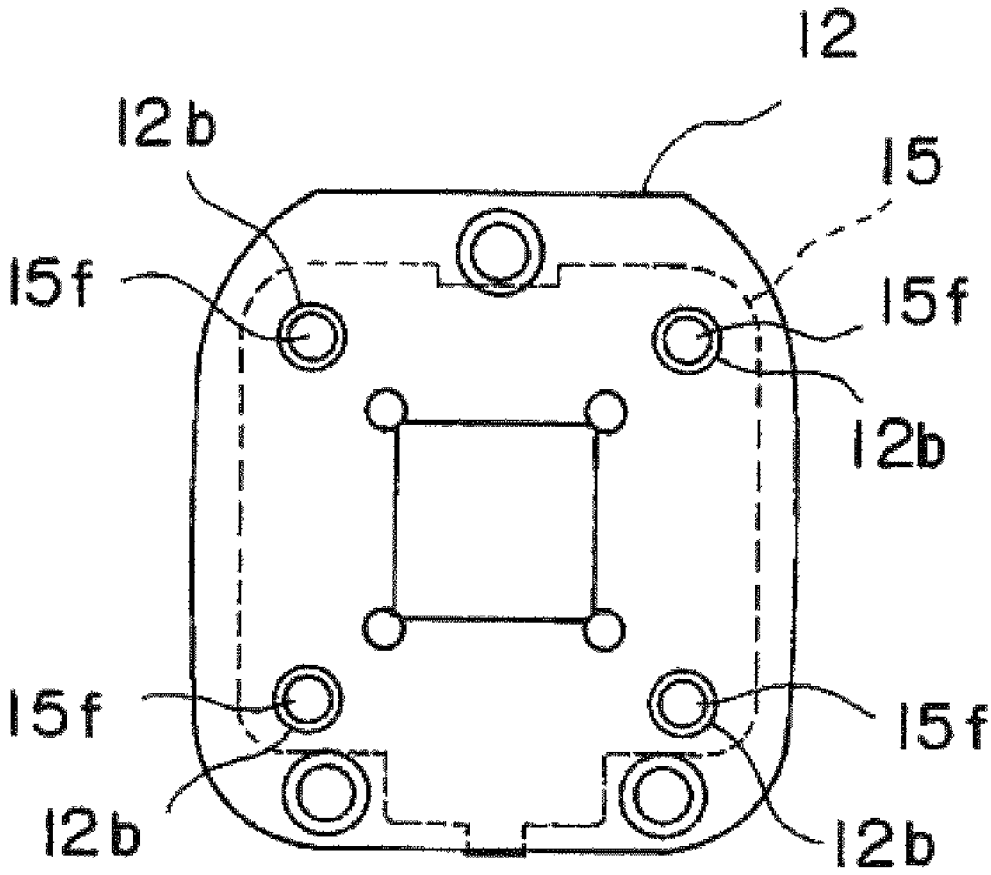
FIG. 6 is a bottom view of the bottom plate shown in FIG. 5A assembled with the gasket shown in FIG. 2A.

Exemplified embodiments of the invention are described below in detail with reference to the accompanying drawings.

An antenna device 50 according to an embodiment of the present invention will be explained below with reference to FIG. 7. The illustrated antenna device 50 is a GPS signal receiving antenna device.

The antenna device 50 includes an antenna case 53, an antenna module 54, a gasket 55, and a signal line 56 which is a coaxial cable. The antenna case 53 is constructed by joining a top cover 51 and a bottom plate 52. The antenna module 54 is housed in the top cover 51. The gasket 55 is provided to a joined portion between the top cover 51 and the bottom plate 52 to ensure a sealing property of the antenna case 53. In this case, the gasket 55 is also called the waterproof packing because this member establishes a waterproofing. The signal line 56 is connected to the antenna module 14.

The antenna module 54 has an antenna element 60 and a circuit board 61. An antenna for receiving the GPS signal transmitted from the GPS satellite is formed on the antenna element 60. A circuit for applying various signal processes such as amplification of the GPS signal received by the antenna element 20, and the like (referred to as a "signal processing circuit" hereinafter) is formed on the circuit board 61. The antenna element 60 and the circuit board 61 are joined mutually with a double-sided tape (not shown), or the like.

The signal line 56 for supplying the GPS signal to the outside of the antenna case 53 is connected to the circuit board 61. Also, a shield case 64 for shielding the signal processing circuit is attached to a main face of the circuit board 61, which is located on the opposite side to the side on which the antenna element 60 is arranged. The signal line 56 is led to the outside through a notched portion formed in the top cover 51 (described later).

Figure 7:
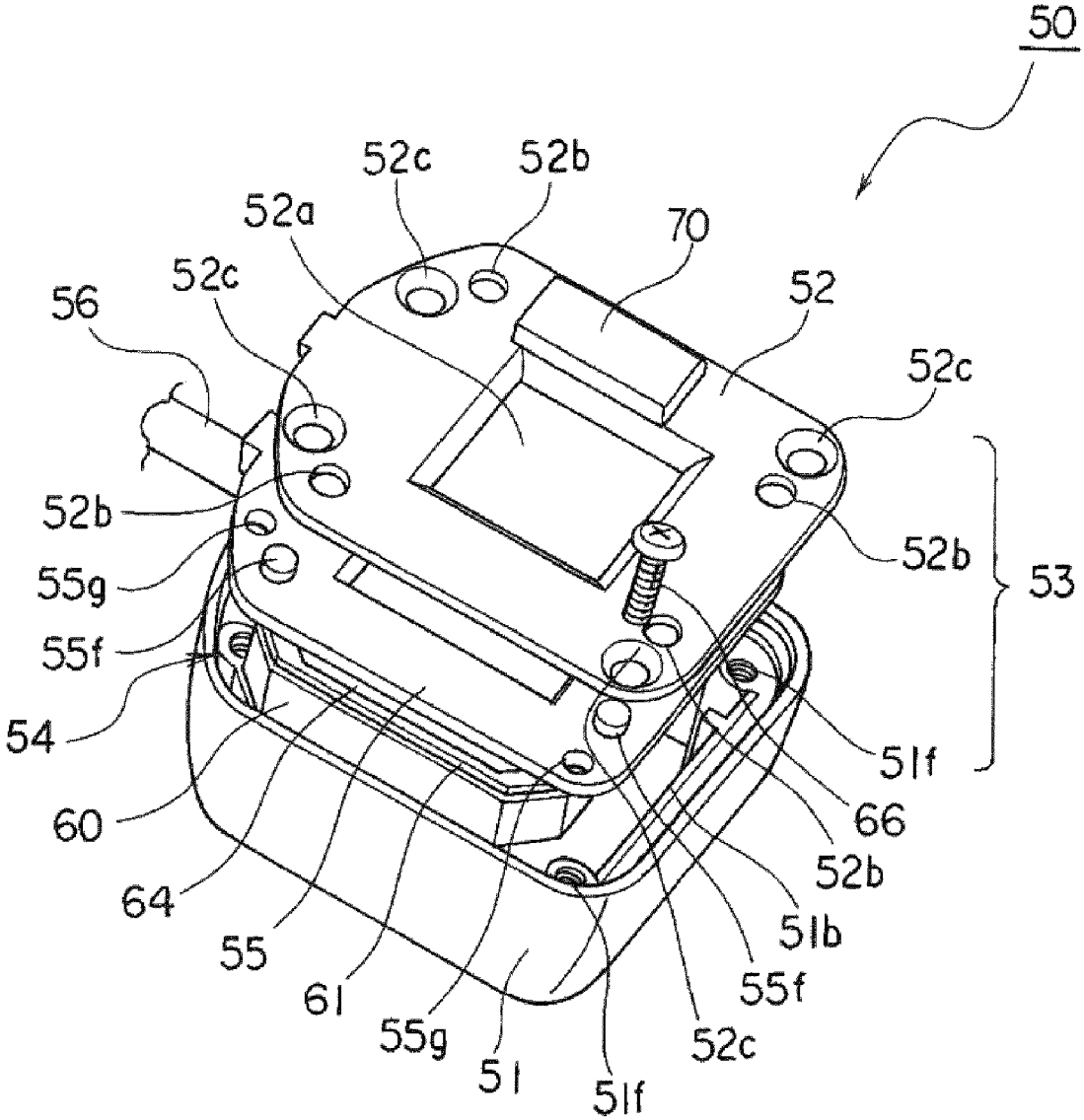
FIG. 7 is a perspective view showing an antenna device according to one embodiment of the present invention viewed from a bottom side in a disassembled state.

The antenna device 50 is integrated when the top cover 51 and the bottom plate 52 are secured mutually by four screws 66 (only one screw 66 is shown in FIG. 7) in a state that the antenna module 54 and the gasket 55 are accommodated in an internal space of the top cover 51.

The gasket 55 is formed of a resin material such as silicon rubber. The gasket 55 has a base portion 55*a* (see FIGS. 8A to 8D) for covering the whole face of the antenna module 54, and a bush 55*b* (see FIGS. 8A to 8B) for covering an outer periphery of the signal line 56 in a position that corresponds to a notched portion 51*a* (see FIGS. 10A to 10E) formed in the top cover 51.

A configuration of the gasket 55 will be explained below in more detail with reference to FIGS. 8A to 8D and FIGS. 9A to 9C.

The base portion 55*a* has a mounting portion 55*c* on which the antenna module 54 is mounted. The position of antenna module 54 is regulated on this mounting portion 55*c*, and mounted thereon.

The gasket 55 is disposed between the top cover 51 and the bottom plate 52 when the top cover 51 and the bottom plate 52 are joined, and is provided for the purpose of ensuring the airtightness at the joining portion. The bush 55*b* is formed upright on the base portion 55*a* in a position that corresponds to the notched portion 51*a* in the top cover 51. The bush 55*b* has a hole portion 55*d*, through which the signal line 56 is passed, in its center portion.

The gasket 55 has a projection 55*e* that extends outward from the lower side of the hole portion 55*d*. This projection 55*e* constitutes a waterproof structure when this portion is brought into contact with the lower side of the signal line 56. The projection 55*e* is provided to expose from the notched portion 51*a* of the top cover 51, and constitutes a part of the face of the antenna main body. Also, the gasket 55 has four projections 55*f* provided on the lower face of the base portion 55*a*. These projections 55*f* pass through the bottom plate 52 and a resin sheet (not shown), and are exposed from the bottom face of the antenna main body. These projections 55*f* serve as a slip stopper when the antenna main body is put on the roof of the automobile.

Returning to FIG. 7, a single concave portion 52*a* is formed on a center portion of the bottom plate 52. A permanent magnet 70 is attached into the concave portion 52*a*. This permanent magnet 70 is provided to attract and fix the antenna device 50 onto the roof of the automobile. Also, the resin sheet (not shown) for protecting the roof of the automobile from scratch is attached onto the main face on the side, which faces to the outside of the bottom plate 52, over the almost whole face of this main face. The model number, the name, etc. of the antenna device 50 are printed on this resin sheet.

A configuration of the top cover 51 will be explained below with reference to FIGS. 10A to 10E.

The top cover 51 has a container portion 51*c* that is encircled with an almost rectangular waterproof rib 51*b*. The waterproof rib 51*b* is formed in vicinity of a cover side wall 51*s* of the top cover 51. The container portion 51*c* contains the box-shaped antenna module 54. Also, protrusions 51*d* are provided integrally with the inner wall top face of the top cover 51 at four locations in the container portion 51*c*. These protrusions 51*d* are provided in the positions that contact the areas near four corners of the antenna element 60.

The top cover 51 has a bush receiver 51*e* for receiving the bush 55*b* of the gasket 55, and four threaded holes 51*f* into which the screw 66 is screwed respectively. These threaded holes 51*f* are provided between the cover side wall face of the top cover 51 and the waterproof rib 51*b*. A top end portion of the waterproof rib 51*b* is brought into the gasket 55 by screwing four screws 66.

The top cover 51 has an annular thick portion 51*g* where an inner wall of the cover side wall 51*s* is increased in thickness. The annular thick portion 51*g* is formed with the waterproof rib 51*b* and a plurality of threaded holes 51*f*.

As described above, the waterproof rib 51*b* is formed on the annular thick portion 51*g* and disposed adjacently to the cover side wall face 51*s* of the top cover 51. Therefore, a product size of the antenna device 50 can be reduced. In other words, a downsizing of the antenna device 50 can be achieved.

Figure 8D:
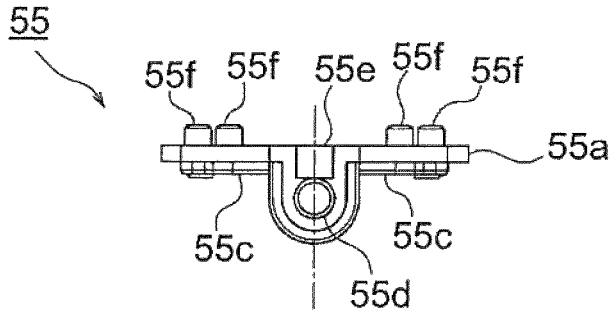
FIG. 8D is a rear view of the gasket shown in FIG. 8A.
Figure 8C:
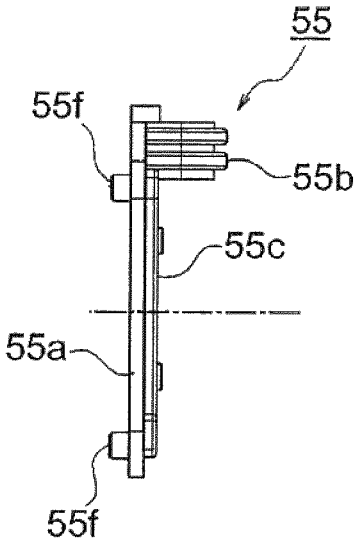
FIG. 8C is a left side view of the gasket shown in FIG. 8A.
Figure 8A:
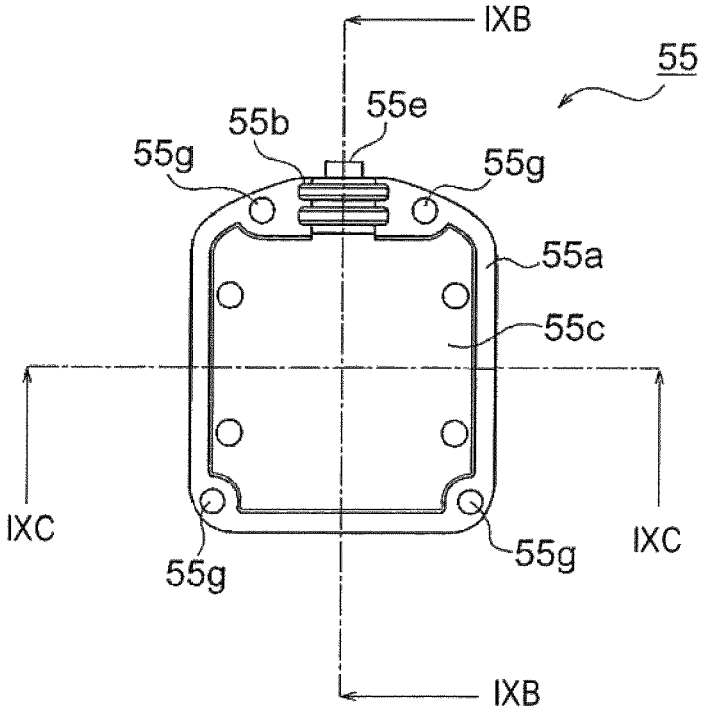
FIG. 8A is a plan view of a gasket of the antenna device shown in FIG. 7.
Figure 8B:
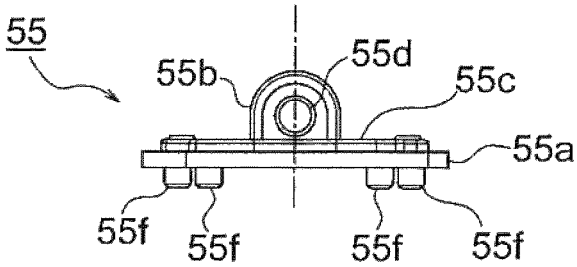
FIG. 8B is a front view of the gasket shown in FIG. 8A.
Figure 9A:
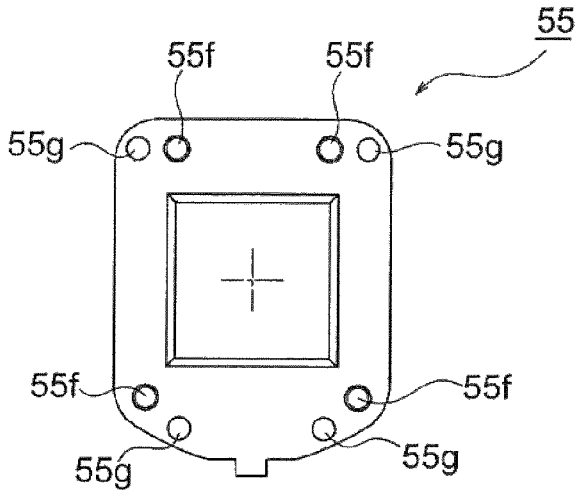
FIG. 9A is a bottom view of the gasket shown in FIG. 8A.
Figure 9B:
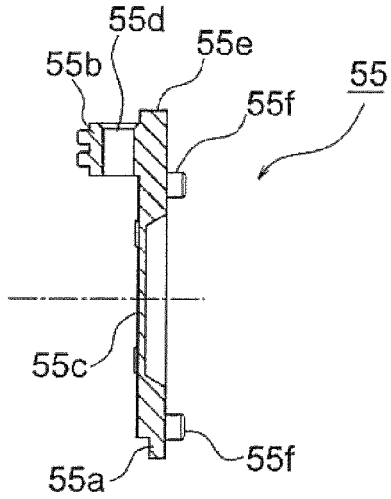
FIG. 9B is a sectional view taken along a line IXB-IXB in FIG. 8A.
Figure 9C:
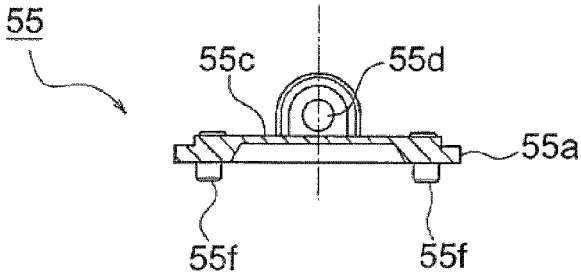
FIG. 9C is a sectional view taken along a line IXC-IXC in FIG. 8A.
Figure 10C:
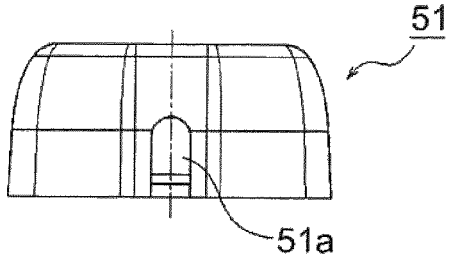
FIG. 10C is a rear view of the top cover shown in FIG. 10A.
Figure 10A:
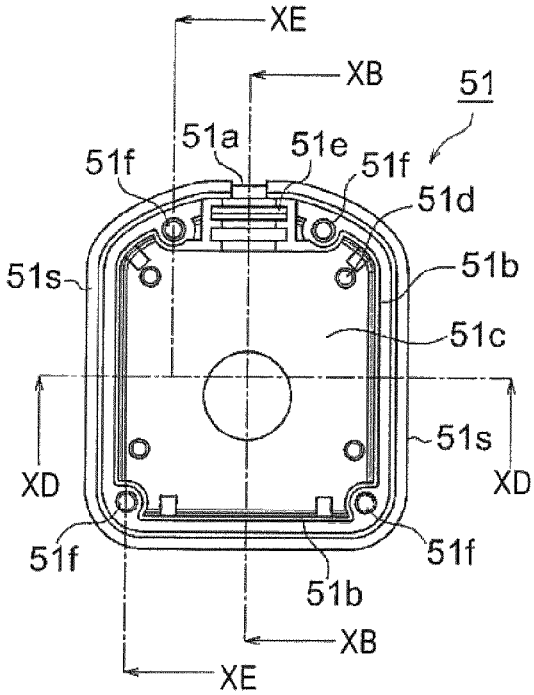
FIG. 10A is a bottom view of a top cover of the antenna device shown in FIG. 7.
Figures 10D, 10E:
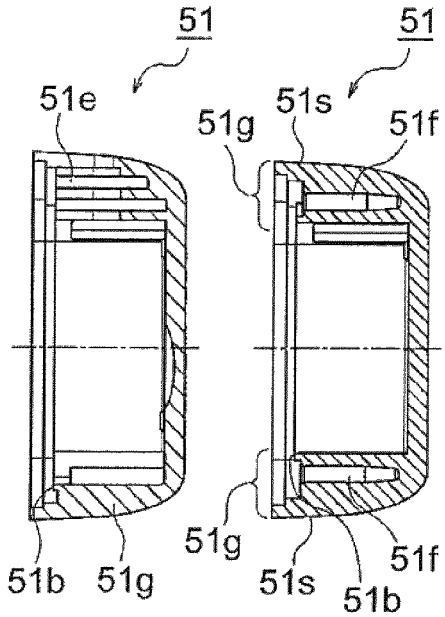
FIG. 10D is a sectional view taken along a line XD-XD in FIG. 10A.
FIG. 10E is a sectional view taken along a line XE-XE in FIG. 10A.
Figure 10B:
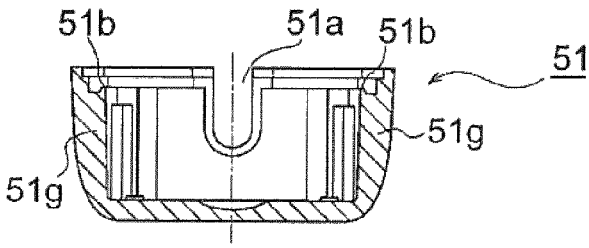
FIG. 10B is a sectional view taken along a XB-XB line in FIG. 10A.

As shown in FIG. 8A and FIG. 9A, the gasket 55 has four through holes 55*g* through which the screw 66 is passed respectively. Therefore, the screws 66 are passed through four through holes 55*g* in the gasket 55 respectively, and are screwed into four threaded holes 51*f* of the top cover 51. As a result, the waterproof property can be enhanced.

Returning to FIG. 7, the bottom plate 52 has four through holes 52*b* through which four projections 55*f* of the gasket 55 are passed respectively. Also, the bottom plate 52 has four holes 52*c* through which four screws 66 are passed respectively.

Figure 11A:
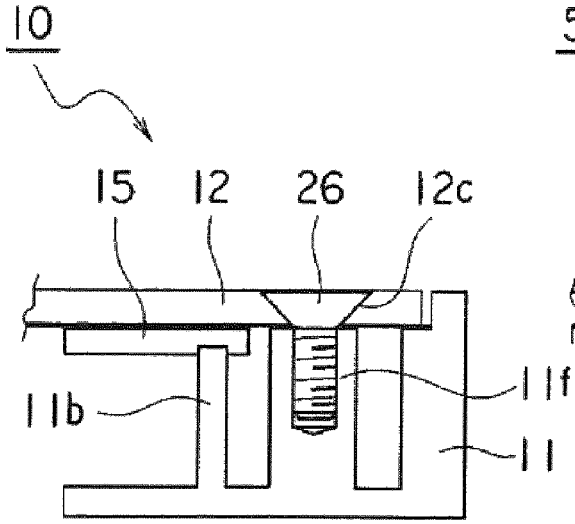
FIG. 11A is a sectional view showing a waterproof structure of the conventional antenna device shown in FIG. 1.

A difference in the waterproof structure between the conventional antenna device 10 shown in FIG. 1 and the antenna device 50 according to the present embodiment shown in FIG. 7 will be explained below with reference to FIGS. 11A and 11B.

Figure 11B:
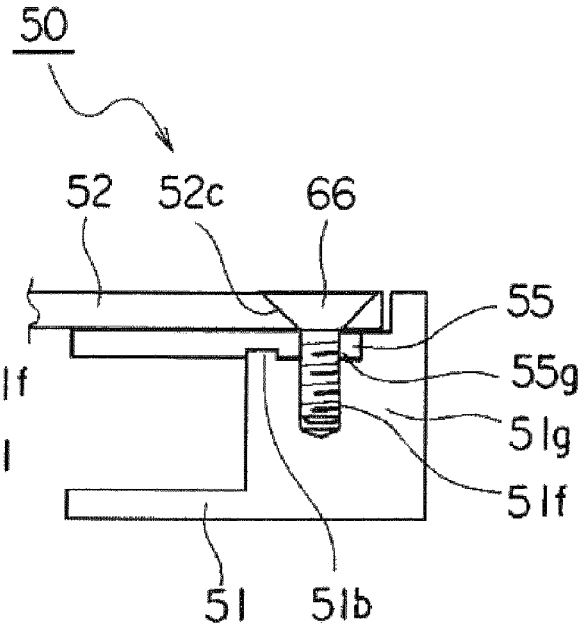
FIG. 11B is a sectional view showing a waterproof structure of the antenna device shown in FIG. 7.

In contrast to the conventional antenna device 10, in the antenna device 50 according to the present embodiment, as shown in FIG. 11B, when four screws 66 are screwed into four threaded bosses 51*f* of the top cover 51 through the holes 52*c* of the bottom plate 52 and the through holes 55*g* of the gasket 55, the gasket 55 is disposed between the top cover 51 and the bottom plate 52 and is fixed by the screws. Therefore, in the antenna device 50 according to the present embodiment, the waterproof property in the inside of the antenna module 14 is ensured not only by virtue of the close contact between the waterproof rib 51*b* provided to the top cover 51 and the gasket 55 but also by the screws 66 that are passed through the gasket 55.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention. For example, the antenna device explained in the above embodiment is suitable for the GPS signal receiving antenna device. But it should be noted that the present invention is not limited to this application, and is applicable as the antenna device for the mobile communications to receive the satellite wave such as the SDARS signal, or the like and the terrestrial wave.

The gasket 55 may have notches covering a part of the screws 26 instead of the four through holes 55*g*.

The disclosure of Japanese Patent Application No. 2008-262315 filed Oct. 9, 2008 including specification, drawings and claims is incorporated herein by reference in it is entirety.

What is claimed is:

1. An antenna device, comprising:

an antenna module configured to receive radio waves;

a plate having a plurality of first through holes;

a cover coupled with the plate to define a space accommodating the antenna module, the cover comprising:

a side wall surrounding the antenna module, the side wall having an end face opposing the plate and formed with a plurality of threaded holes; and a rib projected from the end face;

a gasket having a part formed with a plurality of openings and disposed between the rib and the plate; and a plurality of screws respectively screwed into the threaded holes through the first through holes and the openings, wherein at least a part of each of the screws is surrounded by an associated one of the openings.

2. The antenna device as set forth in claim 1, wherein:

the side wall has a first part having a first thickness and a second part having a second thickness thicker than the first thickness; and the end face is provided in the second part.

3. The antenna device as set forth in claim 1, wherein the antenna module is configured to receive a GPS signal as the radio waves.

4. The antenna device as set forth in claim 1, wherein the antenna device is configured to receive a Satellite Digital Audio Radio Service signal as the radio waves.

5. The antenna device as set forth in claim 1, wherein the openings are second through holes.

6. The antenna device as set forth in claim 5, wherein each of the screws has a screw head having a diameter larger than a diameter of each of the second through holes.

7. A waterproof structure for an antenna device including an antenna module configured to receive radio waves, the waterproofing structure comprising:

a cover adapted to be coupled with a plate having a plurality of first through holes to define a space accommodating the antenna module, the cover comprising:

a side wall adapted to surround the antenna module, the side wall having an end face adapted to oppose the plate and formed with a plurality of threaded holes; and a rib projected from the end face; and a gasket having a part formed with a plurality of openings and adapted to be disposed between the rib and the plate, wherein each of the openings is adapted to surround at least a part of a screw which is configured to be screwed into one of the threaded holes through one of the first through holes and one of the openings.

8. The waterproof structure as set forth in claim 7, wherein:

the side wall has a first part having a first thickness and a second part having a second thickness thicker than the first thickness; and the end face is provided in the second part.

9. The waterproof structure as set forth in claim 7, wherein the openings are second through holes.

10. The waterproof structure as set forth in claim 9, wherein a diameter of each of the second through holes is smaller than a screw head of the screw.

* * * * *